US006499944B1

(12) United States Patent
Beeck et al.

(10) Patent No.: US 6,499,944 B1
(45) Date of Patent: Dec. 31, 2002

(54) TURBO MACHINE

(75) Inventors: Alexander Beeck, Küssaberg (DE); Peter Ernst, Stadel (CH); Shailendra Naik, Gebenstorf (CH); Ulrich Rathmann, Nussbaumen (CH)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/657,304

(22) Filed: Sep. 7, 2000

(30) Foreign Application Priority Data

Sep. 23, 1999 (DE) ..... 199 45 581

(51) Int. Cl.[7] ..... F01D 5/20
(52) U.S. Cl. ..... 415/173.3; 415/175; 415/180
(58) Field of Search ..... 415/173.1, 175, 415/176, 177, 178, 180, 173.3, 173.5, 174.2, 174.5, 230

(56) References Cited

U.S. PATENT DOCUMENTS

| | | | | |
|---|---|---|---|---|
| 3,867,061 A | | 2/1975 | Moskowitz | 415/174 |
| 3,916,054 A | | 10/1975 | Long et al. | 428/117 |
| 4,198,839 A | | 4/1980 | Linko, III et al. | 72/199 |
| 4,989,886 A | * | 2/1991 | Rulis | 277/230 |
| 5,161,942 A | | 11/1992 | Chen et al. | |
| 5,186,252 A | * | 2/1993 | Nishizawa et al. | 165/181 |
| 5,584,659 A | * | 12/1996 | Schmidt | 416/144 |
| 5,649,369 A | * | 7/1997 | Thoren | 33/655 |
| 5,681,661 A | * | 10/1997 | Kelly | 428/601 |
| 6,126,389 A | * | 10/2000 | Burdgick | 415/115 |
| 6,302,642 B1 | * | 10/2001 | Nagler | 415/116 |

FOREIGN PATENT DOCUMENTS

| | | |
|---|---|---|
| DE | 2163068 | 7/1972 |
| DE | 2833012 C2 | 3/1979 |
| DE | 4432685 C1 | 11/1995 |
| EP | 0 935 009 | 11/1999 |
| GB | 1 376 966 | 12/1974 |
| GB | 2 145 478 | 3/1985 |
| GB | 2 293 417 | 2/1996 |

* cited by examiner

*Primary Examiner*—Edward K. Look
*Assistant Examiner*—Richard A. Edgar
(74) *Attorney, Agent, or Firm*—Burns, Doane, Swecker & Mathis, L.L.P.

(57) ABSTRACT

A heat shield of a turbo machine is provided with a microstructure. In a preferred embodiment, the microstructure element comprises a plateau, which is arranged on a rib in such a way that the structure has a "T"-shaped cross section. The ribs are preferably embodied as plates set on edge on the heat shield and are aligned with their surface perpendicular to the circumferential direction (U) of the turbo machine. This results in low bending dimensional rigidity in the circumferential direction. In this way, it is possible to accommodate scraping of a component involved in relative motion in the circumferential direction without plastic deformation. Moreover this arrangement gives the maximum possible resistance to a leakage flow. When used at high temperatures, it is furthermore advantageous to provide ways to enable a coolant to be supplied to the microstructure.

16 Claims, 11 Drawing Sheets

10
31
2211
2212
R
U
h
220
40
222

TURBO MACHINE

FIELD OF THE INVENTION

The invention generally relates to a turbo machine. More specifically, the invention relates to the configuration of the surface structure of heat shields built into a turbo machine.

BACKGROUND OF THE INVENTION

In general, components involved in relative motion in turbo machines cannot be sealed using contact seals. There is thus a leakage gap between a heat shield and a blade tip, for example. The leakage via this gap has negative effects on the power and efficiency of the turbo machine. However, reducing the size of the leakage gap increases the risk that the blade and the heat shield will scrape against one another, leading to machine failure with serious consequences. Numerous measures were therefore taken in the past to construct these components in such a way that scraping could be tolerated. A hard/soft friction pair is produced by means of special contact coatings and contact tips, one of the friction partners abrading or plastically deforming the other if scraping occurs. In this way, scraping is as if it were buffered, but the leakage gap is permanently enlarged.

The use of conventional elastic means, such as brush seals, fails as soon as they are used in the first stages of a gas turbine and indeed also in the high-pressure part of a modern turbo compressor: in this case, it is only possible to use components which, on the one hand, are resistant to high temperatures and, on the other hand, allow efficient cooling of all components exposed to hot gas.

SUMMARY OF THE INVENTION

It is the aim of the present invention, in the case of a turbo machine of the type stated at the outset, to specify means by which leakage gaps between components involved in relative motion can be reduced, which means must furthermore meet the conditions that they accommodate scraping of the components within reasonably to be expected limits by means of purely elastic deformation, such that, after scraping, the leakage gap is not permanently enlarged due to plastic deformation. At the same time, it must be possible to produce these means from materials which are resistant to high temperatures, and efficient cooling of the means must be possible if necessary.

This is achieved by means of the features of the present invention.

The essence of the invention is therefore to provide the surface of a heat shield situated opposite a component involved in relative motion with a microstructure, such microstructures being known per se from coating technology and helping there to produce a more intimate connection between a substrate and a layer. In the present application, however, the microstructure is used directly as a surface of the component. In this context, the microstructure is designed in such a way that its elements have low dimensional rigidity in the direction of the relative motion. If scraping occurs, the elements of the microstructure can then yield, this yielding movement being accommodated purely by elastic deformation. It is thus possible to design leakage gaps to be smaller, and any scraping which may occur does not lead to permanent enlargement of the leakage gap. It is advantageous, especially when using the invention in gas turbines, to provide the heat shield—or some other component which is provided with a microstructure—with means which allow a cooling medium to be fed to the microstructure.

In a leakage gap, a special embodiment of the microstructure is preferred. In this case, the microstructure element takes the form of a plateau which is offset from the component underneath, that is to say the heat shield for example, and which is connected to the component by a rib. The rib, for its part, is a thin plate which is set on edge on the component and is preferably aligned with its surface normal to the expected leakage flow. The plateau and the rib then have the shape of a "T" in section. When used on a heat shield, the "T"-shaped configuration can be seen when looking in the axial direction of the turbo machine according to the invention. Overall, this configuration has the following advantages: with their large surface, the ribs obstruct a leakage flow directed from the blade delivery side to the blade intake side, that is to say essentially in the circumferential direction, obstructing it to a large extent though not completely. The obstruction of leakage can be further improved by a combination of different structural elements; the optimum structure for this purpose must be determined as appropriate for the particular case. By virtue of the use of the plate-shaped ribs in their specific orientation, the microstructure elements do have a high-strength in the axial direction of the turbo machine but, in the circumferential direction, a rib includes essentially only of the neutral bending axis. This results in a low dimensional rigidity, in particular a low moment of resistance of the microstructure elements to bending in the circumferential direction of the machine, and a very large bending range in which only elastic but no plastic deformation occurs. It may furthermore prove to be advantageous not to arrange the ribs in a precisely perpendicular manner on the component but to tilt them slightly in the expected direction of scraping, ensuring easier deformation. Microstructure elements of this kind can not only buffer any scraping in a particularly suitable manner, like the contact coatings described in the introduction, but scraping of the blades against the heat shield is literally cushioned. By virtue of the plateaus, in turn, the microstructure forms cavities between its surface and the actual surface of the heat shield, these cavities being well delimited from the leakage flow precisely by the plateaus. On the one hand, this prevents hot gas ingress into the microstructure and, on the other hand, coolant which is introduced into the cavities is used very efficiently.

A slight variation in the "T"-shaped microstructure elements is obtained if the plateau is arranged in an edge region of the rib. These microstructure elements take the shape of a capital Greek letter "gamma" (Γ). These microstructure elements essentially have the same advantages as the "T"-shaped microstructure elements. A particularly high degree of security against jamming of the microstructure elements in the event of scraping is obtained especially if the ribs slope toward the side on which the plateaus project.

The microstructure described on a heat shield thus presents only very little resistance to scraping of a blade tip, thus avoiding damage to the blade in the event of scraping. The microstructure, in turn, is deformed only elastically. When the cause of scraping—generally an unfortunate combination of differential thermal expansions—is no longer present, the microstructure reassumes its original shape, and the leakage gap has not been permanently enlarged. A special shape of the microstructure elements obstructs any leakage flows that may arise within the microstructure, reducing them to a minimum. Good coolability of the structure ensures a long service life, even in the case of extreme ambient conditions.

Microstructure elements with a dovetail cross section have essentially the same properties as the structures with a "T"-shaped cross section described above, and can in a certain sense be regarded as a variant of this embodiment.

The extent of the microstructure over the component must of course be chosen by the person skilled in the art in accordance with the application. A "vertical" structure dimension in a range of from 1 to 5 mm above the actual surface of the component has proven to be advantageous on a heat shield.

In another preferred embodiment, the microstructure comprises rod-shaped elements, which are arranged in a tetrahedral shape for example. The rod-shaped elements can also serve as a support structure for an essentially two-dimensional grid arranged thereon. A diamond-shaped structure has proved to be advantageous for such a grid. The size of two obtuse angles enclosed in a diamond is advantageously between 90° and 160°. The grid should preferably be arranged in such a way that the expected direction of scraping represents the angle bisector of the obtuse angles. In this arrangement, the diamonds have a low dimensional rigidity and can be practically folded up by a scraping component. Irrespective of the shape of the microstructure, the microstructure elements can be coated. Primary consideration will be given here to ceramic protective layers whose thickness is significantly less than the dimension of the structure, the structured surface thus being retained, these layers serving as a protection against oxidation, for example.

BRIEF DESCRIPTION OF THE DRAWINGS

The invention will be described below with reference to exemplary embodiments illustrated in the drawing. The drawing and the examples must not of course be used to limit the scope of protection provided by the claims but serve only to make the invention more easily understood. In particular.

DETAILED DESCRIPTION OF THE INVENTION

Figure 1:
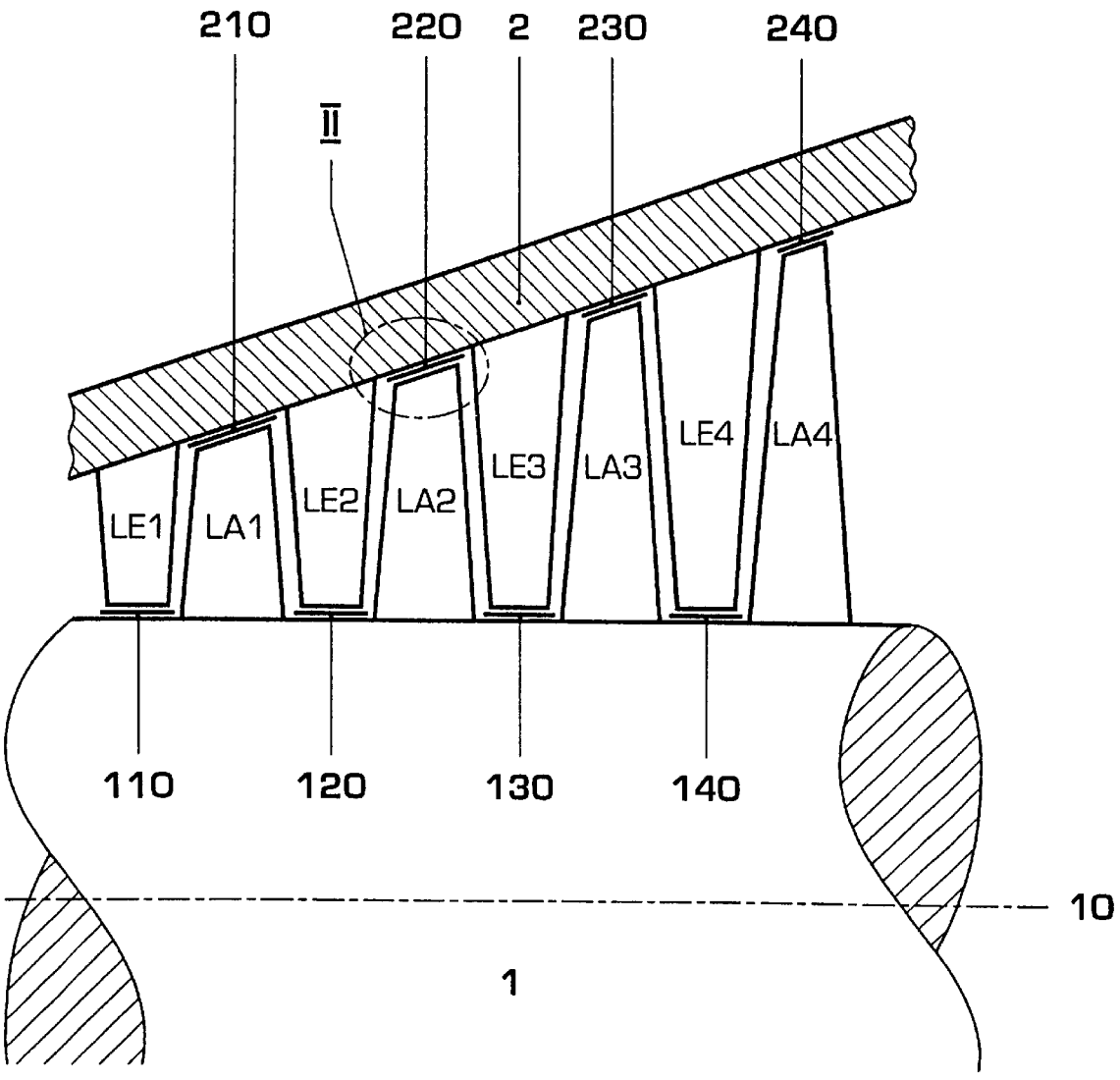
FIG. 1 shows a four-stage turbine of a gas turbine set.

FIG. 1 shows a four-stage turbine of a gas turbine set. The invention can of course also be implemented in a steam turbine or a turbo compressor. In operation, a shaft 1 rotates about an axis 10 of the turbine. Rotor blades LA1 to LA4 and rotor heat shields 110, 120, 130, 140 are secured on the shaft. Guide blades LE1 to LE2 and stator heat shields 210, 220, 230 and 240 are arranged in the casing 2. In this arrangement, each heat shield lies opposite a blade tip which is moved relative to the heat shield in operation.

Figure 2:
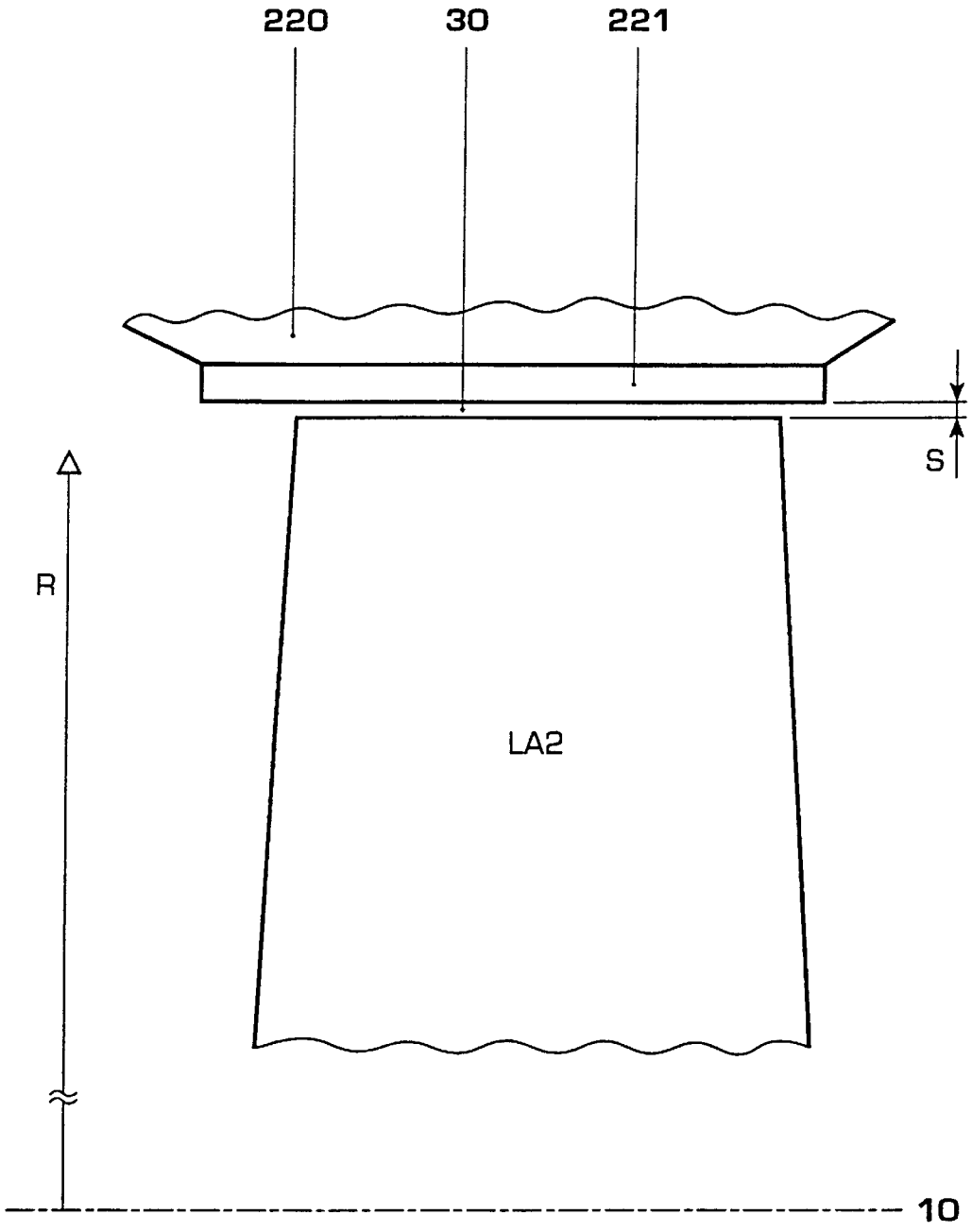
FIG. 2 shows an enlarged view of the region of a heat shield embodied in accordance with the invention for the turbine in FIG. 1.

In FIG. 2, the area surrounding the heat shield 220 is illustrated on an enlarged scale. The heat shield is secured in the casing (not shown here) in a manner which is not relevant to the invention. On a surface which faces the tip of the rotor blade LA2, the heat shield is provided with a microstructure 221, which is illustrated only schematically at this initial stage. In the radial direction R, the components LA2 and 220, 221 involved in relative motion have a clearance s. The clearance s should be dimensioned sufficiently in the installation condition to avoid scraping of the components involved in relative motion in the event of differential thermal expansions. On the other hand, the clearance s should be kept small in operation since the clearance 8 defines a leakage gap 30 which should be kept small in the interests of efficiency and power. According to the invention, the dimension s of the leakage gap 30 should be made so small that the rotor blade LA2 scrapes against the heat shield 220 or microstructure 221 in the event of an unfortunate combination of differential expansions in the machine. According to the invention, the microstructure should be configured in such a way that it has only a low dimensional rigidity and a high elasticity in the direction in which scraping occurs, i.e. in this case in the circumferential direction. In this way, the microstructure can accommodate scraping without permanent deformation of one of the components involved in scraping.

Figure 3:
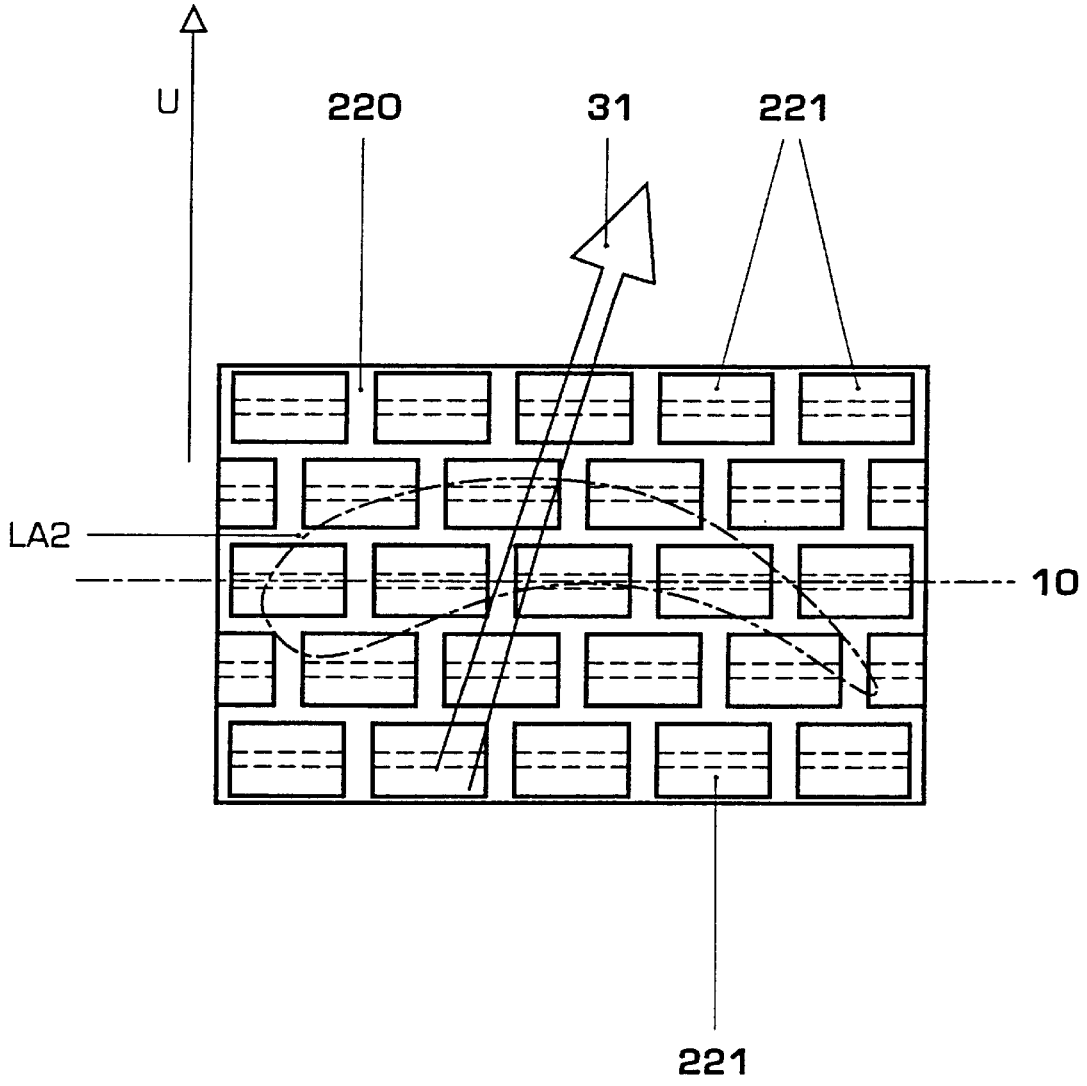
FIG. 3 shows a plan view of this heat shield.
Figure 4:
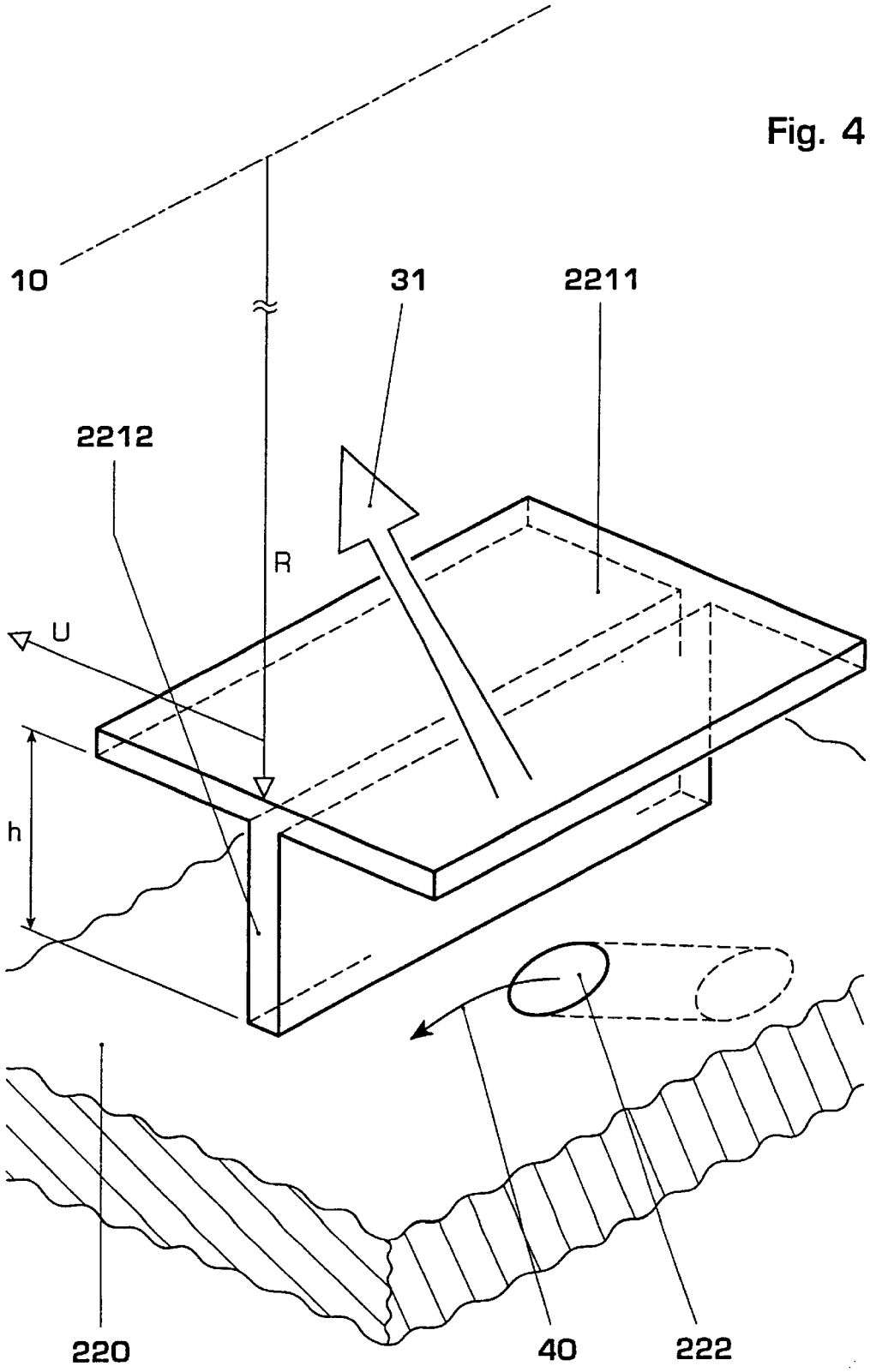
FIG. 4 shows a detailed perspective representation of a cut-away portion of this heat shield.

FIGS. 3 and 4 show one example of the implementation of a microstructure with these properties. FIG. 3 shows a view of a casing heat shield of a turbo machine according to the invention from the direction of the machine axis 10. The microstructure 221 is arranged on the heat shield 220. In operation, the rotor blade LA2 is moved in the circumferential direction U relative to the heat shield and the microstructure. A leakage flow 31 directed essentially from the delivery side to the intake side of the blade LA2 will be established in the leakage gap 30 (not shown here). FIG. 4 shows a cut-away view of a heat shield 220 in a perspective representation, in which significantly more details can be seen. Arranged on the heat shield 220 is a rib 2212 in the form of a plate set on edge. The plateau 2211 of the microstructure is arranged on this rib at a distance h from the heat shield. The dimension h must be adapted to the specific application of the microstructure by the person skilled in the art; when used on heat shields, a dimension of 1 to 5 mm will be found to be appropriate in most cases.

Figure 5:
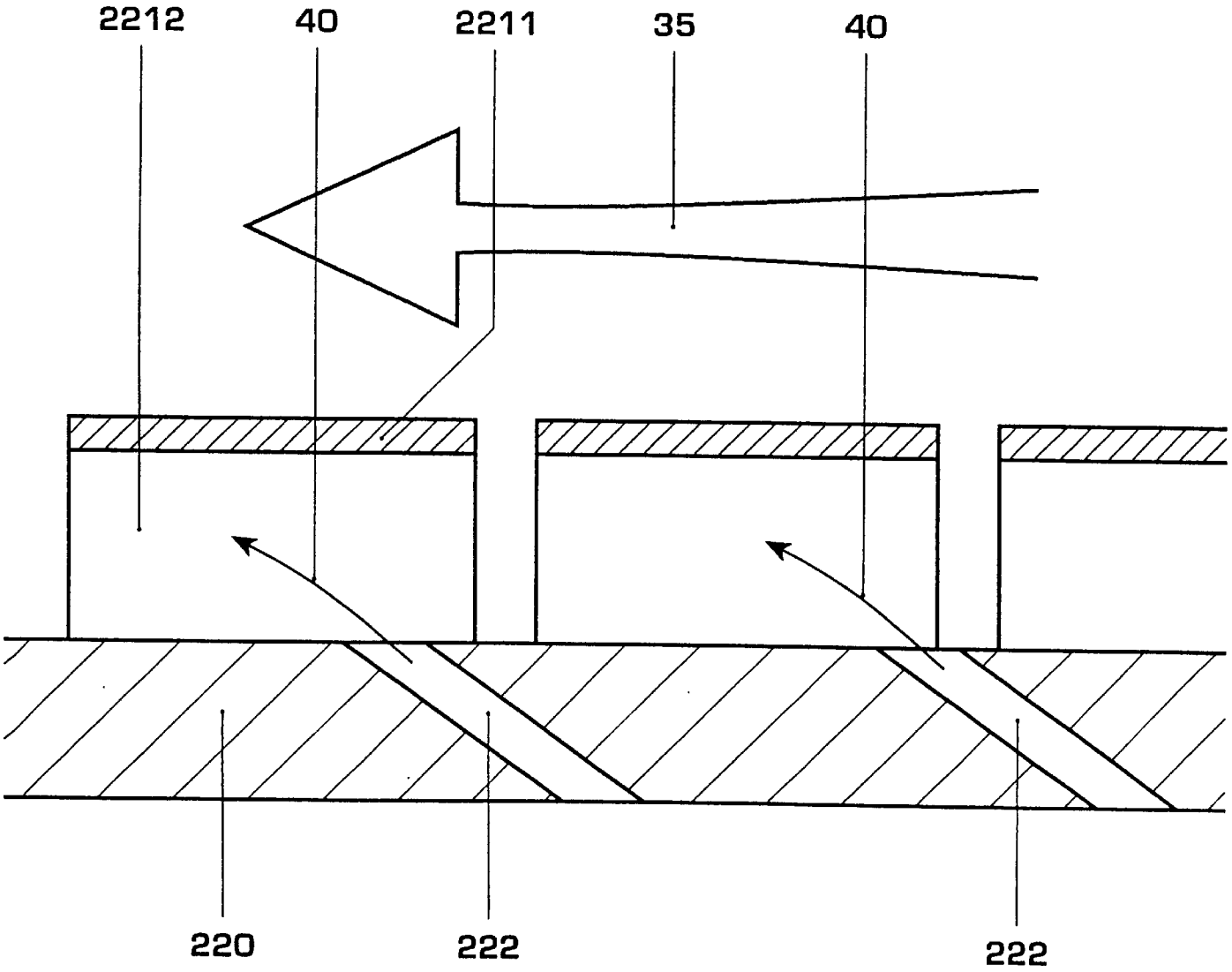
FIG. 5 shows part of the heat shield in a different view.

FIG. 4 shows a cooling opening 222, through which a coolant 40 can be fed to the microstructure. In the case of a microstructure embodied as illustrated, the plateaus 2211 and the heat shield 220 enclose a volume which has only a relatively small connection to the main flow. A quantity of cooling air will therefore mix only very slowly with a flow of hot gas flowing over the microstructure, and the heat transfer between the coolant and the main flow is therefore very low. As a consequence, efficient cooling of the microstructure can take place, making possible a long service life of the microstructure, even when the temperatures of the flow of hot gas are high. The cooling configuration is illustrated again in detail in a different view in FIG. 5. A component 220 is provided on a surface with a microstructure, over which a flow 35 of hot gas flows. A coolant 40 for the microstructure is blown out through cooling openings 222 in the component. The plateaus largely prevent exchange between the coolant 40 and the hot gas 35. On the one hand, this prevents the ingress of hot gas into the region between the plateaus 2211 and the component 220 and, on the other hand, it severely limits the mixing of coolant 40 with the flow 35 of hot gas, resulting in efficient usage of the coolant 40.

Figure 6A:
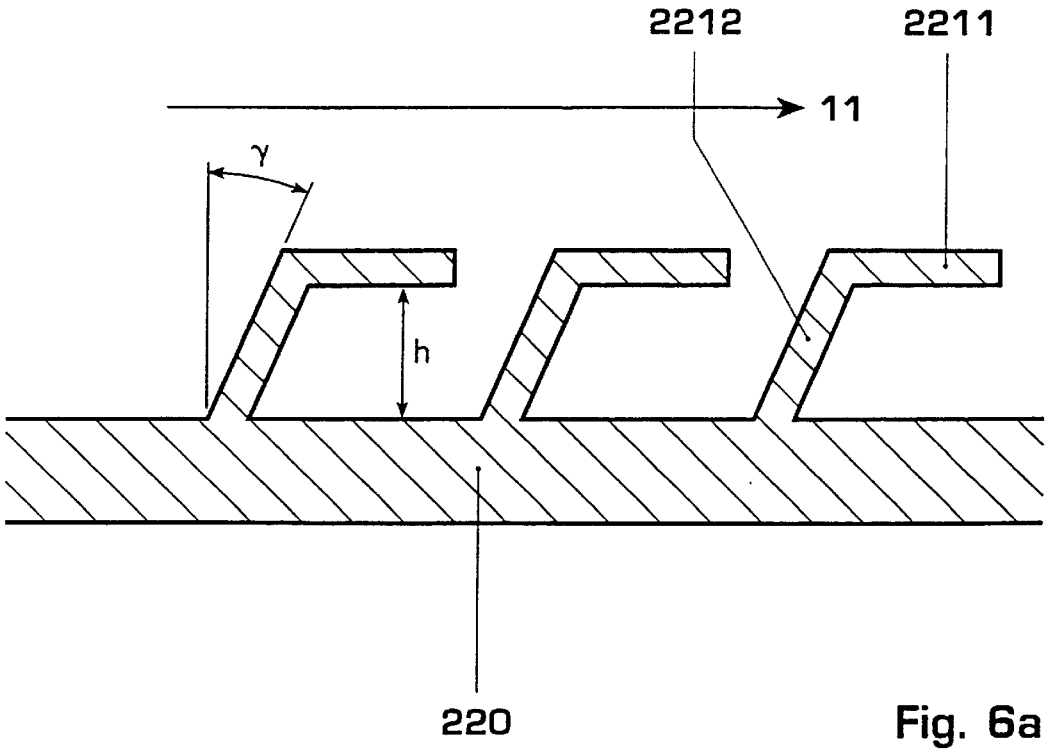
FIG. 6 shows a second preferred variant of the microstructure.
Figure 6B:
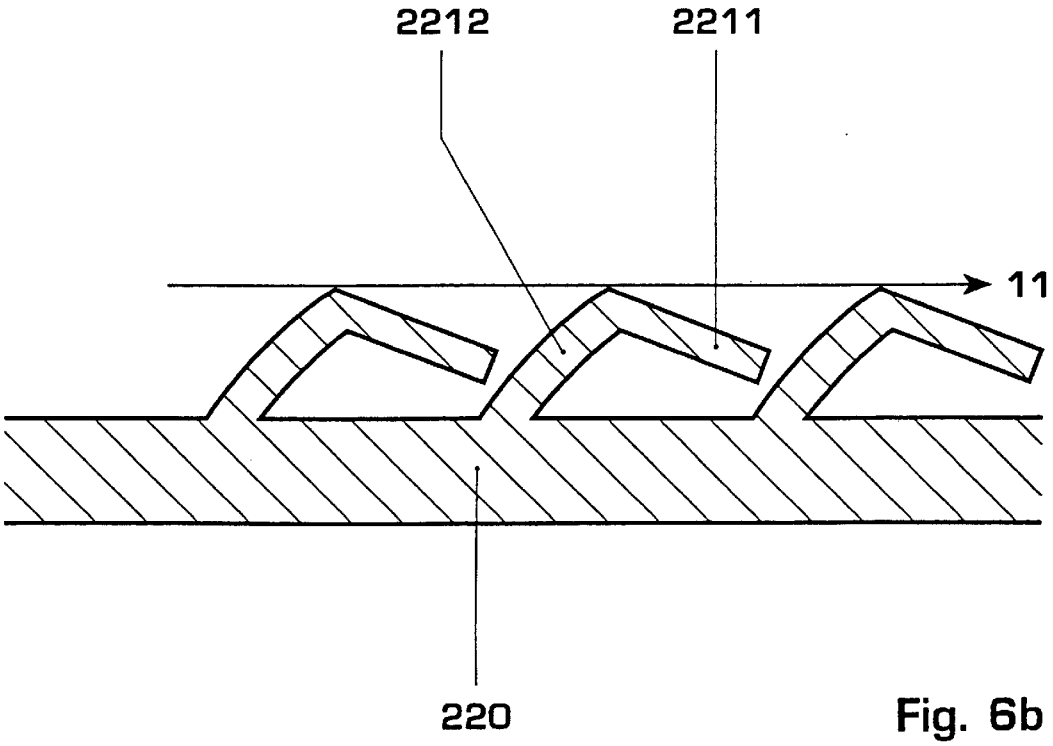

FIG. 6 shows a modification of the "T"-shaped microstructure elements in cross section. The plateaus 2211 are arranged at one end of the ribs 2212 and project away from the ribs in the direction of the expected direction 11 of scraping. The ribs slope at an angle $\gamma$ to the normal of the component 220 and likewise in the direction of the expected scraping. FIG. 6*a* shows the microstructure in the normal condition. FIG. 6*b* illustrates an instance of scraping. By virtue of the special geometry of the microstructure elements, there is no danger that parts of the microstructure elements will jam with the scraping component during the process of scraping. The slope of the ribs furthermore ensures that the elements have a particularly low dimensional rigidity with respect to scraping. In other respects, these elements have the same potential as the "T"-shaped elements discussed above.

Figure 7:
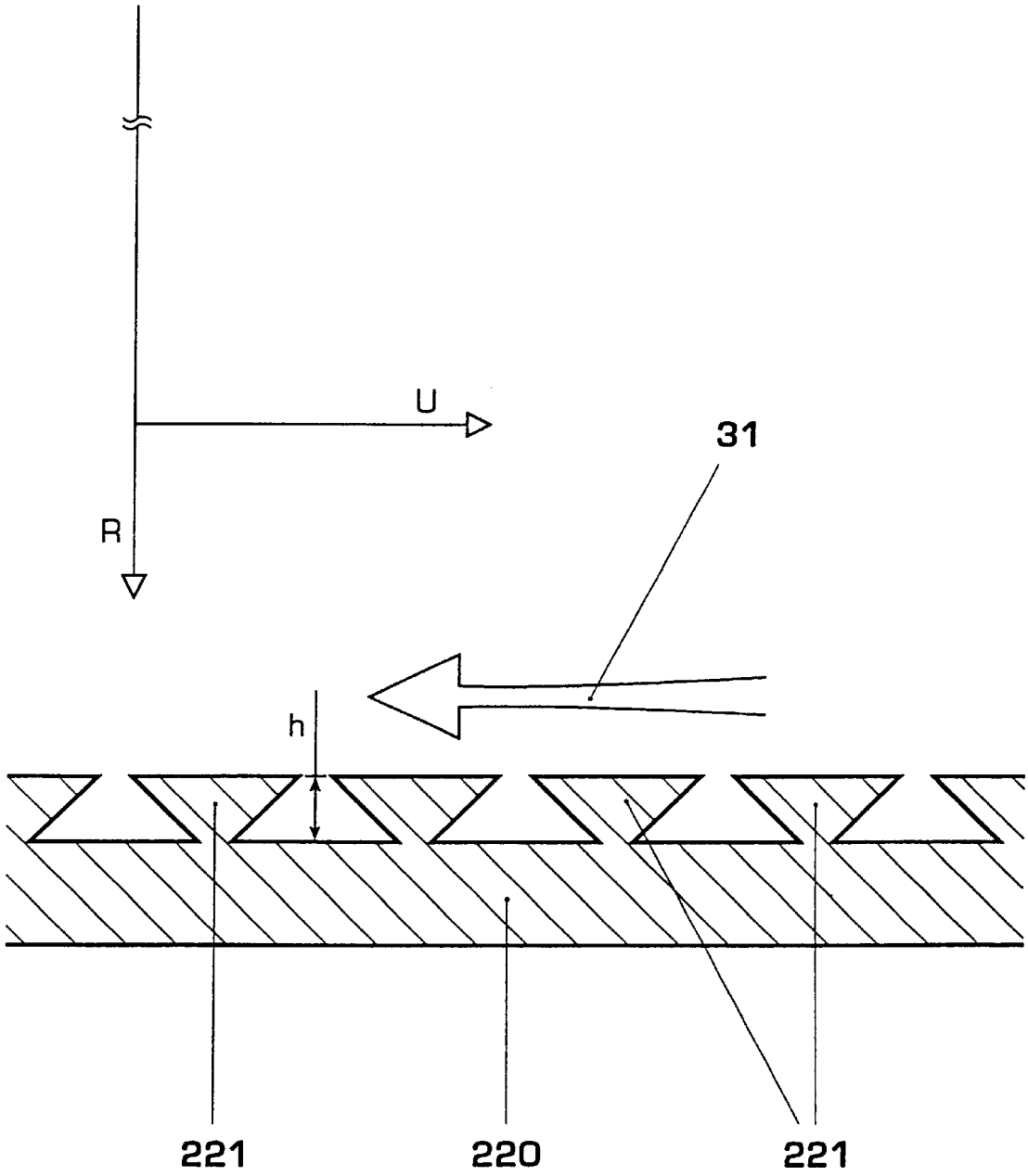
FIG. 7 shows another preferred variant of the microstructure.

Of course, the above-illustrated shape of the microstructure does not represent a limitation. Where expedient, there is a large number of other structural geometry options available for use in microstructure engineering, as frequently employed on components to be coated ceramically in order to achieve a mechanically robust connection between a metallic substrate and a ceramic layer. Honeycomb structures are known, for example. The microstructure elements can have a dovetail cross sections, as illustrated in FIG. 7. Such cross sections are known and are employed to allow the use of undercuts for a positive connection between a component such as that illustrated and a thick ceramic layer to be applied, which covers the microstructure. According to the invention, the structures are employed without applied layers or with thin layers, in which case the structure of the surface is retained. FIG. 7 also shows a component 220, a heat shield for example, to one surface of which microstructure elements 221 with a dovetail cross section have been applied. When used on a heat shield, these are once again aligned with their longitudinal axis in the direction of the machine axis, that is to say transversely to the circumferential direction U and essentially transversely to the leakage flow 31. The dovetail structure can be regarded as a variant of the "T"-shaped structure explained above, and similar embodiments are preferred.

Figure 8:
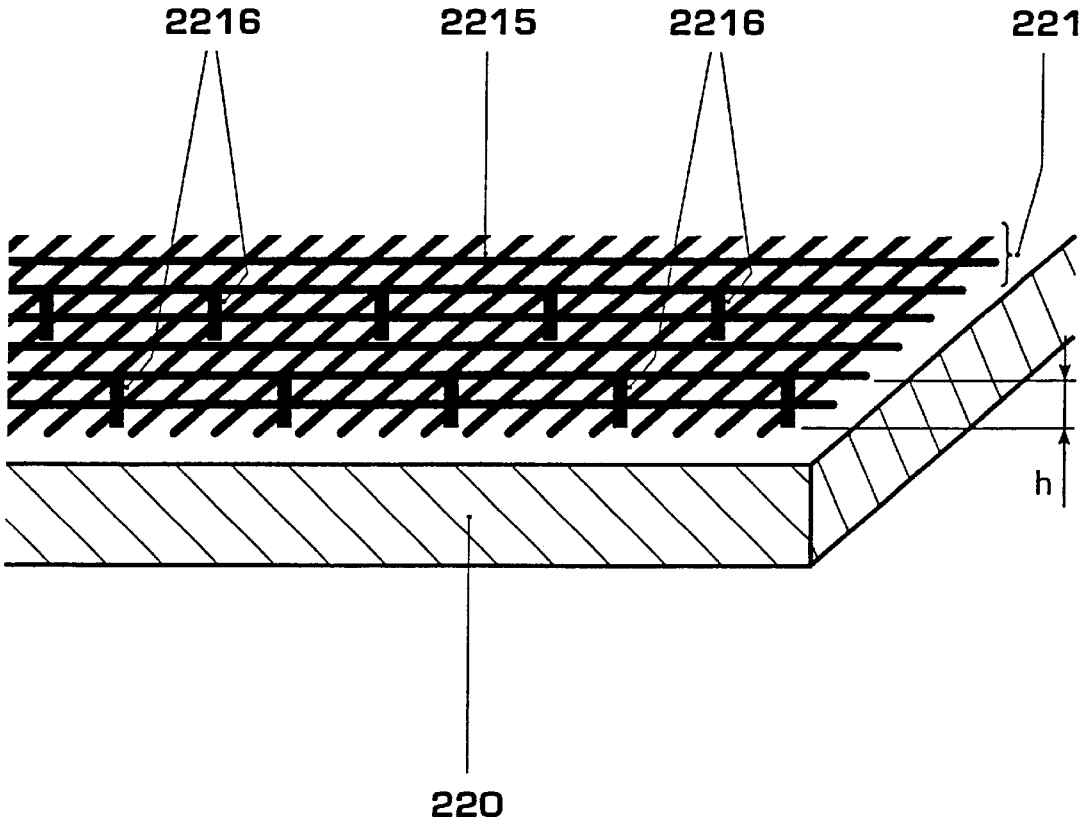
FIG. 8 shows an alternative embodiment of the microstructure.

The use of a grid 2215, arranged in a raised position on a component 220 by means of spacers 2216, as a microstructure 221 has furthermore been disclosed, in EP 0 935 009 for example, FIG. 8. In the publication cited, however, the microstructure is completely filled in a further process step with a ceramic coating, the thickness of which is greater than the dimension of the structure. On the finished component, the microstructure can no longer be identified as such and it serves merely to ensure better adhesion of an applied ceramic material. In the invention discussed here, the microstructure is retained directly as a surface of the component. According to the invention, ceramic layers, which are applied, for example, to prevent oxidation, are significantly thinner than the dimension of the microstructure, with the result that, after coating, the microstructure is retained as a surface of the component.

Figure 9:
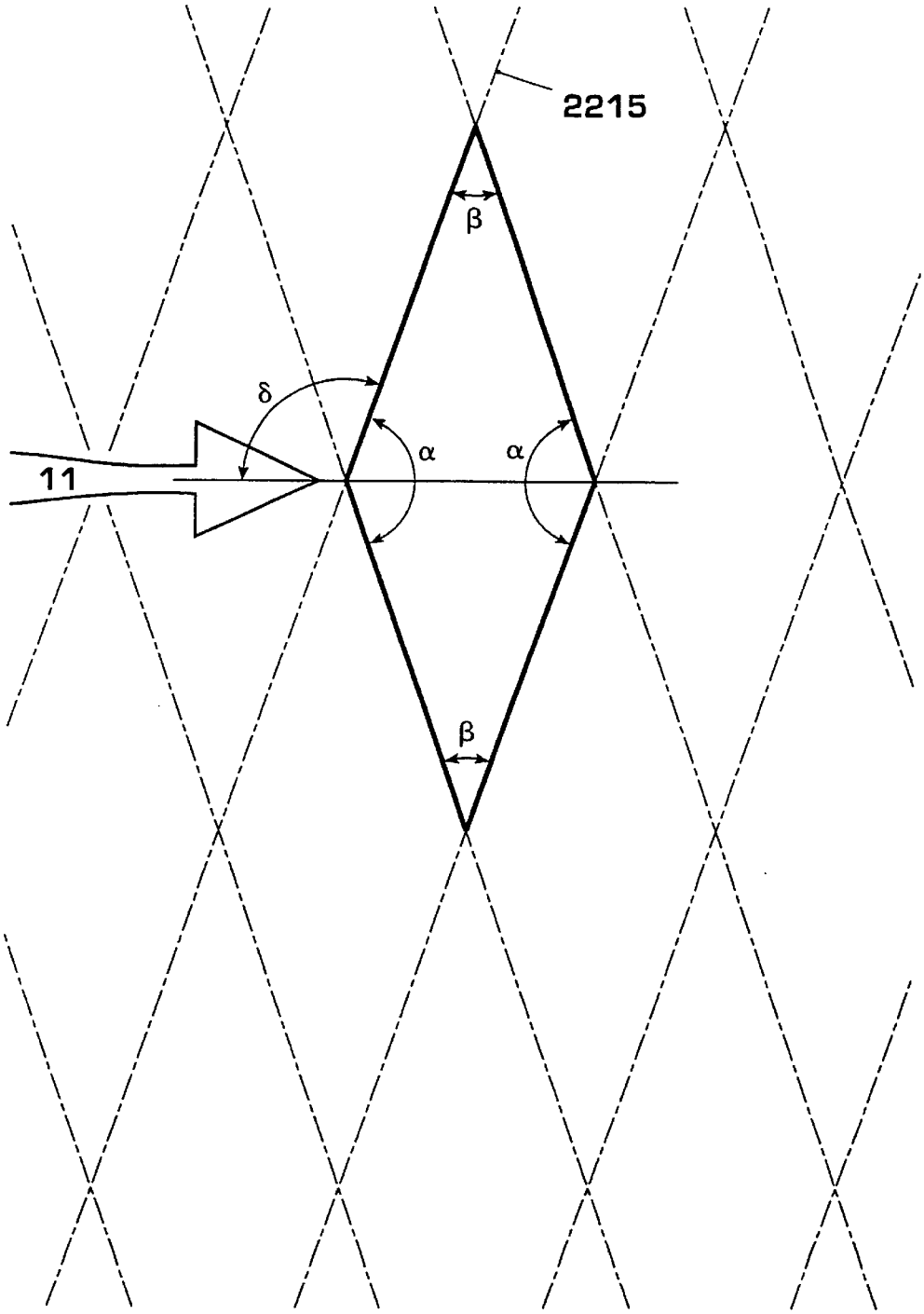
FIG. 9 shows a detail of the embodiment in FIG. 8.
Figure 10:
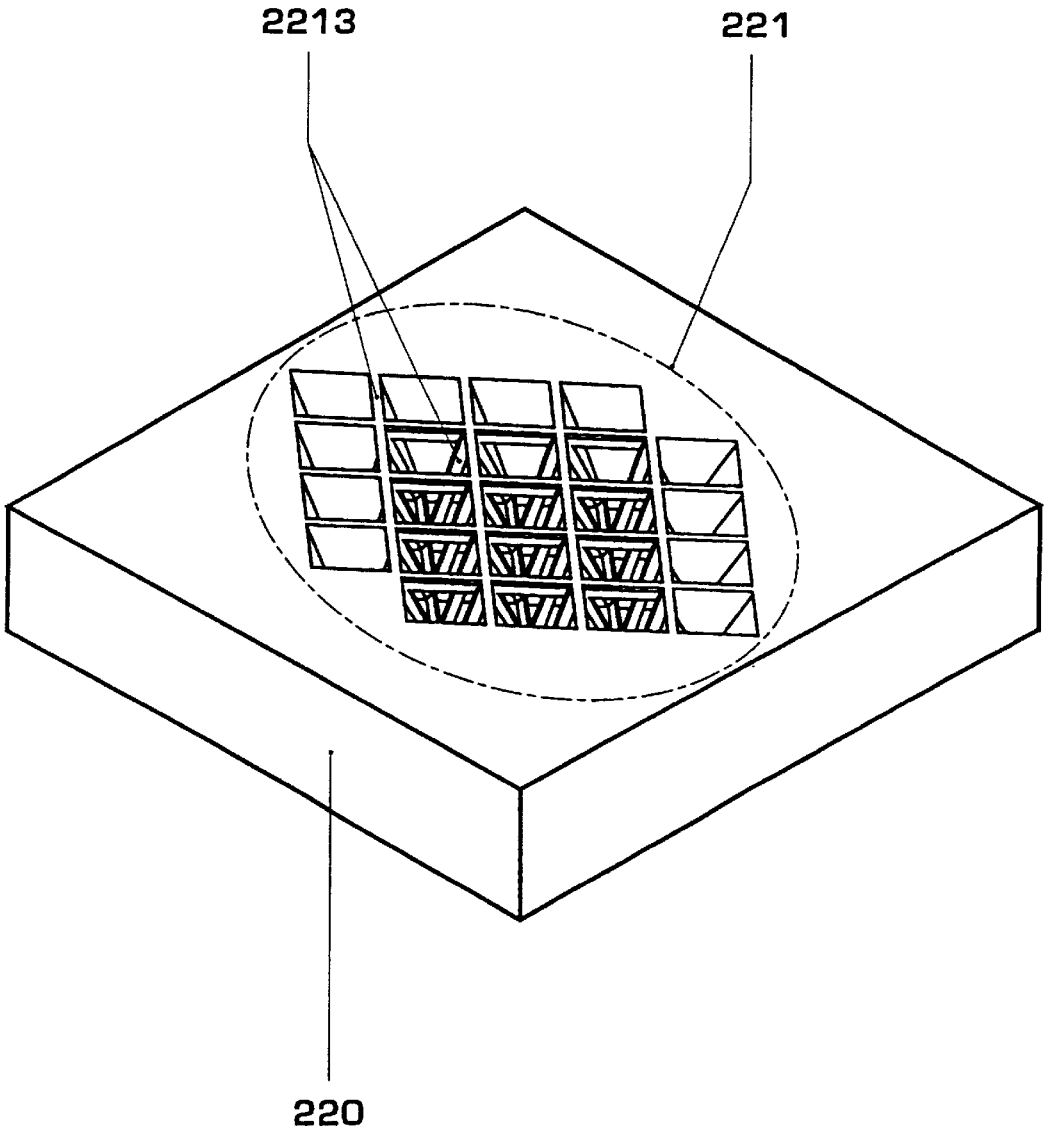
FIG. 10 shows another alternative embodiment.
Figure 11:
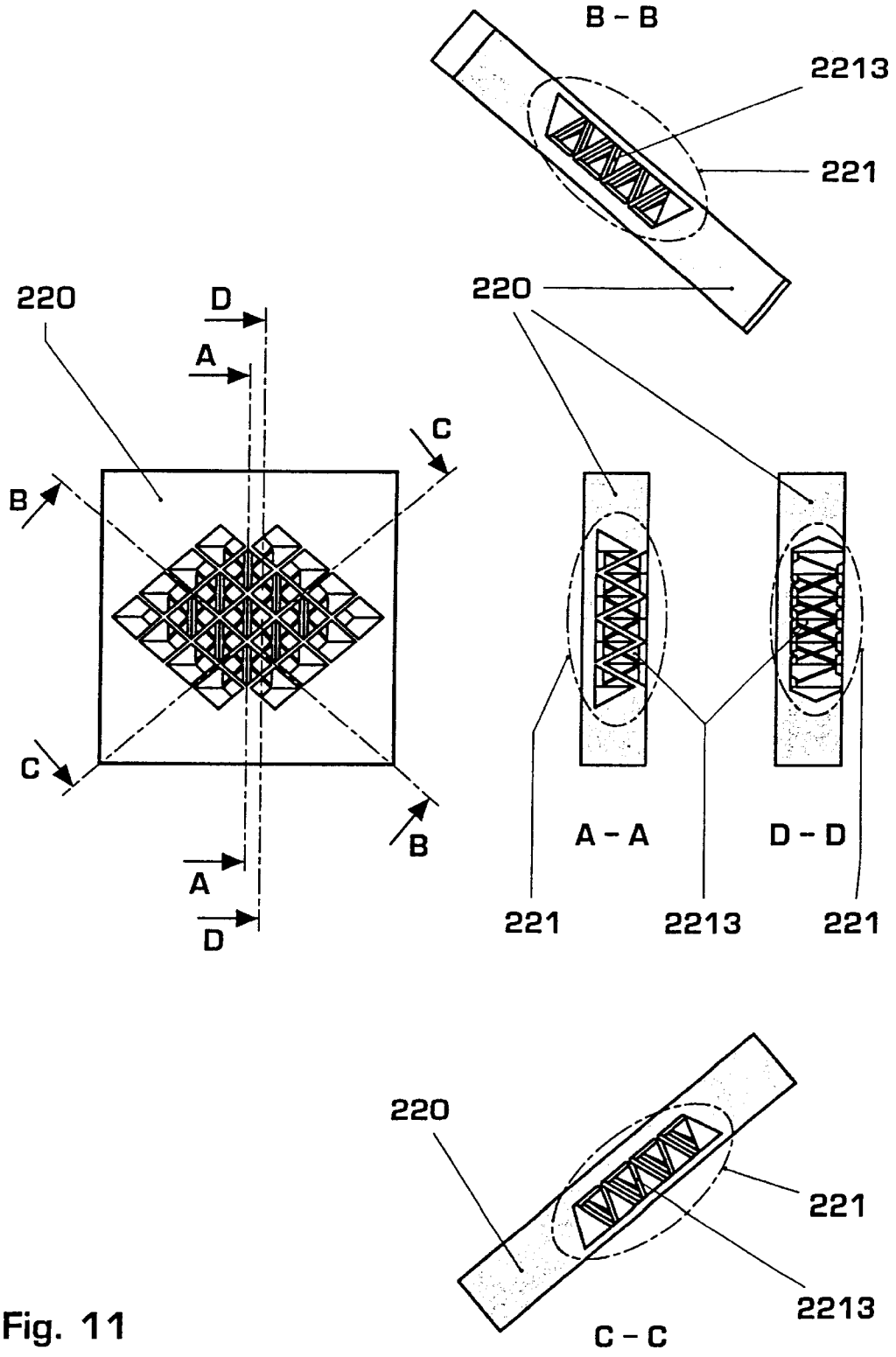
FIG. 11 shows a number of details of the embodiment in FIG. 10.

EP 0 935 009 describes the embodiment of a grid of this kind in a hexagonal configuration. This is likewise possible with the invention described here. For functional reasons, however, a diamond-shaped grid which encloses two obtuse angles $\alpha$ between 90° and 160° is preferred, FIG. 9. It is advantageous to position the grid in such a way relative to the expected direction 11 of scraping that the diamonds are arranged transversely to the expected direction of scraping and an angle $\delta$ between the sides of the diamonds and the direction of scraping is between 100° and 135°. The expected direction 11 of scraping approximately forms an angle bisector of the angle $\alpha$. In this way, the diamonds are as it were folded up in a particularly simple manner during the scraping process and pose as little resistance as possible to a scraping component. Another embodiment of the microstructures is illustrated in FIGS. 10 and 11. These consist as it were of a network of interconnected rod-shaped elements 2213, which are arranged in a tetrahedral shape, for example. To illustrate the microstructure 221 more accurately, various sections through a component with such a microstructure are illustrated in FIG. 11.

It is furthermore possible in the case of all the microstructure applications according to the invention—and the geometries illustrated above in no way exhaust the possibilities—to provide measures for cooling the microstructure elements.

Although this invention has been illustrated and described in accordance with certain preferred embodiments, it is recognized that the scope of this invention is to be determined by the following claims.

What is claimed is:

1. A turbo machine comprising:

heat shields secured in a casing, said beat shields having surfaces that lie opposite components involved in relative motion;

a leakage flow for flowing in a gap between one of said heat shields and one of said components involved in relative motion during operation;

said leakage flow being minimized by appropriate dimensioning of the gap;

wherein the heat shield has a microstructure on the surface lying opposite the component involved in relative motion, said microstructure having a low dimensional rigidity and a high elasticity in the direction of relative motion, such that scraping of the component involved in relative motion is accommodated by elastic deformation of the microstructure, wherein the heat shields comprise cooling channels for introducing a cooling medium directly into the microstructure.

2. The turbo machine as claimed in claim 1, the microstructure comprising individual microstructure elements, wherein the microstructure elements have the form of plateaus, each said plateau being arranged in a raised manner on a heat shield and being connected to the heat shield by a supporting structure.

3. The turbo machine as claimed in claim 2, wherein each and plateau projects from the supporting structure in the direction of an expected direction of scraping.

4. The turbo machine as claimed in claim 2, wherein the supporting structure slopes at an angle ($\gamma$) in the direction of an expected direction of scraping.

5. The turbo machine as claimed in claim 2, wherein the supporting structure comprises a rib, said rib having the form of a plate set on edge on the surface of the heat shield.

6. The turbo machine as claimed in claim 5, wherein the plate is aligned with its surface toward a circumferential direction (U) of the turbo machine and has a blocking effect in the circumferential direction of the turbo machine.

7. The turbo machine as claimed in claim 1, wherein the microstructure elements have a dovetail cross section.

8. The turbo machine as claimed in claim 1, wherein the microstructure comprises a network of rod-shaped elements.

9. The turbo machine as claimed in claim 8, wherein the rod-shaped elements are arranged in a tetrahedral shape.

10. The turbo machine as claimed in claim 1, wherein the microstructure takes the form of a grid arranged in a raised manner on the heat shield.

11. The turbo machine as claimed in claim 10, wherein the grid comprises a hexagonal structure.

12. The turbo machine as claimed in claim 10, wherein the grid comprises diamond-shaped elements.

13. The turbo machine as claimed in claim 12, wherein a diamond-shaped element encloses two angles ($\alpha$), which measure between 90° and 160°.

14. The turbo machine as claimed in claim 12, wherein an angle ($\delta$) enclosed by a side of a diamond-shaped element and an expected direction of scraping is between 100° and 135°.

15. The turbo machine as claimed in claim 1, wherein the extent (h) of the microstructure above the surface is more than 1 mm and less than 5 mm.

16. The turbo machine as claimed in claim 1, wherein said heat shields are secured on a rotor.

* * * * *